US008458839B2

(12) United States Patent
Porter

(10) Patent No.: US 8,458,839 B2
(45) Date of Patent: Jun. 11, 2013

(54) APPARATUS AND METHOD FOR REPLACING A BRIDGE USING A PRE-CAST CONSTRUCTION TECHNIQUES

(75) Inventor: Paul Westley Porter, Jacksonville, FL (US)

(73) Assignee: Encon Technologies, LLC, Jacksonville, FL (US)

( * ) Notice: Subject to any disclaimer, the term of this patent is extended or adjusted under 35 U.S.C. 154(b) by 487 days.

(21) Appl. No.: 12/685,317

(22) Filed: Jan. 11, 2010

(65) Prior Publication Data

US 2011/0016645 A1 Jan. 27, 2011

Related U.S. Application Data

(60) Provisional application No. 61/228,753, filed on Jul. 27, 2009, provisional application No. 61/250,698, filed on Oct. 12, 2009.

(51) Int. Cl.
*E01D 21/00* (2006.01)
*E01D 19/02* (2006.01)

(52) U.S. Cl.
USPC ..... 14/77.1; 14/75

(58) Field of Classification Search
USPC ..... 14/77.1, 77.3, 75, 78; 52/301; 403/335, 403/337, 338
See application file for complete search history.

(56) References Cited

U.S. PATENT DOCUMENTS

| | | | | |
|---|---|---|---|---|
| 272,426 | A * | 2/1883 | Gray et al. | 405/254 |
| 1,233,743 | A | 7/1917 | Arndt | |
| 1,954,070 | A * | 4/1934 | Cook | 405/254 |
| 3,034,162 | A | 5/1962 | Vincent | |
| 3,209,508 | A | 10/1965 | Mauritz | |
| 3,296,640 | A | 1/1967 | Gunn | |
| 3,376,011 | A | 4/1968 | Petchuk | |
| 4,045,936 | A | 9/1977 | Sterner | |
| 4,102,096 | A | 7/1978 | Cody | |
| 4,123,031 | A * | 10/1978 | Hyre | 249/24 |
| 4,745,724 | A | 5/1988 | Reetz | |
| 4,821,480 | A | 4/1989 | Silvey | |
| 4,880,203 | A | 11/1989 | Holcomb et al. | |
| 4,957,186 | A | 9/1990 | Reetz | |
| 4,977,636 | A | 12/1990 | King | |
| 5,072,911 | A | 12/1991 | Logsdon | |
| 5,255,996 | A * | 10/1993 | Kiat et al. | 404/43 |
| 5,385,432 | A * | 1/1995 | Kiyomiya et al. | 405/204 |
| 5,987,680 | A * | 11/1999 | Sakaya | 14/73 |
| 6,038,823 | A | 3/2000 | Gallimore et al. | |
| 6,663,322 | B1 * | 12/2003 | Listle | 405/239 |
| 7,363,671 | B2 * | 4/2008 | Snead | 14/77.1 |
| 7,571,577 | B2 * | 8/2009 | Nanayakkara | 52/250 |
| 2003/0217420 | A1 | 11/2003 | Snead | |
| 2004/0148717 | A1 | 8/2004 | Kornatsky | |
| 2005/0172427 | A1 * | 8/2005 | Sykes | 14/75 |
| 2005/0194000 | A1 | 9/2005 | Todack | |

(Continued)

*Primary Examiner* — Thomas B Will
*Assistant Examiner* — Abigail A Risic
(74) *Attorney, Agent, or Firm* — Smith Gambrell & Russell LLP

(57) ABSTRACT

A method and apparatus for replacing a bridge using pre-cast materials, including steel piles, steel reinforced concrete caps, and metallic male and female connectors. The pre-cast materials can be formed to precise standards in a controlled factory environment before being brought to the worksite for the bridge replacement project. Further, the male and female connectors provide for a quick and robust way to connect the caps to the piles without the use of welding between the piles and the caps.

21 Claims, 9 Drawing Sheets

U.S. PATENT DOCUMENTS

2005/0262651 A1* 12/2005 Snead ..... 14/77.1
2007/0163058 A1 7/2007 Hornsi
2007/0251031 A1* 11/2007 Tokuno et al. ..... 14/75
2008/0072510 A1 3/2008 Wells et al.
2009/0282626 A1* 11/2009 Powers ..... 14/77.1

* cited by examiner

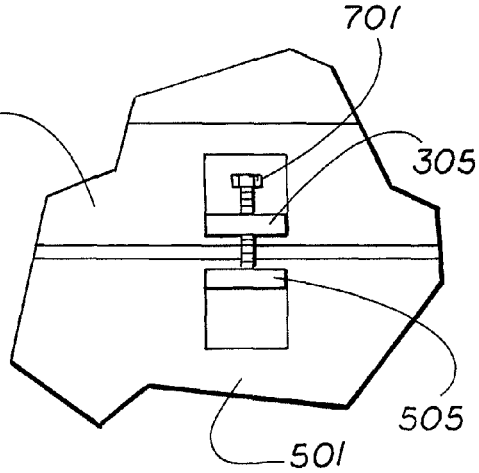
Fig_7
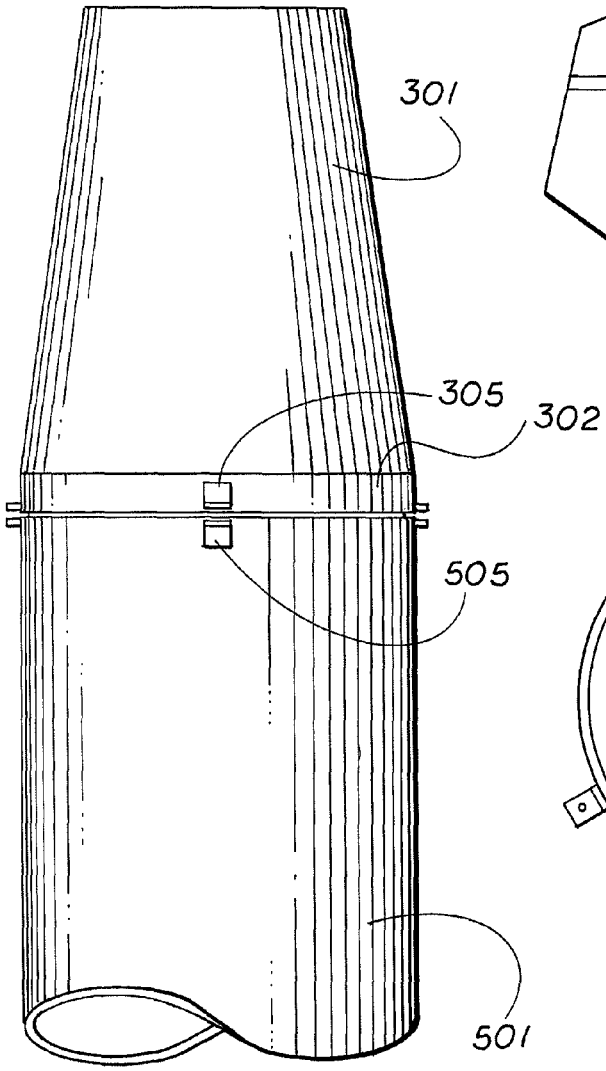
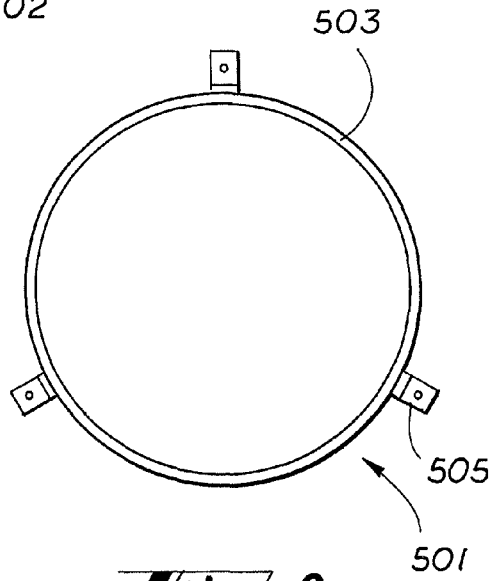
Fig_6
Fig_5

APPARATUS AND METHOD FOR REPLACING A BRIDGE USING A PRE-CAST CONSTRUCTION TECHNIQUES

CROSS-REFERENCE TO RELATED APPLICATIONS

This application claims priority to U.S. provisional application No. 61/228,753, filed Jul. 27, 2009, and U.S. provisional application No. 61/250,698, filed Oct. 12, 2009, both of which are incorporated herein by reference

BACKGROUND OF THE INVENTION

In the railway industry, little has changed over the years in the methods of railway bridge construction. Since the beginning of railway bridge construction, vertical members ("piles") were driven into the ground in successive rows across the width of a waterway or other geographic depression. Each row of piles typically contained two-six vertical piles made of timber. A horizontal timber member ("cap") was then placed across the top of each row of timber piles, creating a series of "bents", each bent comprising two-six vertical piles and a single horizontal cap. Horizontal timber members ("stringers") were then placed to connect successive bents, creating the superstructure of the bridge. Finally, the road deck, cross ties, ballast, and rails were added to complete construction of the railway bridge.

Over the past 150 years, however, these bridges have deteriorated to the point that they have been rebuilt several times over the course of the years. Initially, the bridges were repaired by driving new timber pile bents between the existing bents, and then replacing the timber stringers to span the new bents. The older bents were then removed by simply cutting their piles at ground level, leaving a substantial portion of the old pile stubs still in the ground.

This process would be repeated several times over the decades, eventually leaving a congested area beneath the bridge full of stubs of old piles. Eventually, the area beneath the bridge became so congested with the stubs of old piles that this method could no longer be used without removing the pile stubs at significant cost to the railroad.

Subsequently, modern replacement methods were developed, typically involving the use of a single pair of steel piles per replacement bent, each pile being driven into the ground on either side of the congested area immediately beneath the existing bridge. Once these steel piles were driven into the ground and reinforced with steel and concrete, the engineers would use cast-in-place construction techniques to cast a concrete cap atop the pair of driven steel piles. Typically, the engineers would begin this cast-in-place technique by placing a cap form around the tops of each pair of driven piles. Next, the engineers would position reinforcing bars ("rebar") inside the cap form. Finally, the engineers would pour concrete into the form and allow it to cure.

Further, to minimize the time period for disrupting traffic over an existing bridge, such replacement bents were typically built at a height slightly lower than the existing bridge. Thus, the substructure of the replacement bridge could be built while rail traffic still flowed over the existing bridge. Once the replacement bridge substructure was complete, traffic would be stopped on the rail line. The old bridge would then be dismantled, new spans would be placed atop the new bents, and the approaches to the old bridge would be modified so the rail line could use the new bridge.

This method of bridge repair has certain drawbacks, however. First, the method is quite time consuming and expensive because the caps for the replacement bridge must be carefully cast, in situ, without damaging the existing bridge or disrupting the traffic traveling over the existing bridge. Also, the concrete in the caps must be given time to cure before the caps can support loads and the replacement bridge can be completed. Furthermore, the practice of casting the caps at the worksite necessitates the use of local concrete and reinforcing materials, the quality of which is variable from one concrete plant to the next.

This method also has the drawback that the replacement bridge must be placed at a lower elevation than the existing bridge because the replacement bridge must be built beneath the existing bridge to allow rail traffic to flow during construction. The lower elevation of the replacement bridge reduces the clearance between the replacement bridge and an underlying waterway, thus potentially interfering with shipping and increasing the likelihood that the replacement bridge may be affected by flooding. The lower replacement bridge elevation may also necessitate that additional building permits be obtained and/or environmental impact studies be conducted.

SUMMARY OF THE INVENTION

Disclosed herein is a method and apparatus for replacing a bridge using pre-cast materials, including steel piles, steel reinforced concrete caps, and metallic male and female connectors. These materials can be formed to precise standards in a controlled factory environment before being brought to the worksite for the bridge replacement project. Further, the connectors described herein provide for a quick and robust way to connect the caps to the piles without the use of welding. The connectors also permit a cap to be removed relatively quickly from its piles for maintenance or replacement purposes. Finally, the alignment system disclosed herein ensures that the female connectors maintain the proper spacing during the casting and reinforcing of the concrete caps.

BRIEF DESCRIPTION OF THE DRAWINGS

FIG. 5 is a side view of a male connector that has been attached to the top of a steel pile.

FIG. 6 is a top plan view of the steel pile of FIG. 5.

FIG. 7 is a detailed view of the level adjustment devices shown in FIG. 5.

DETAILED DESCRIPTION

Figure 1:
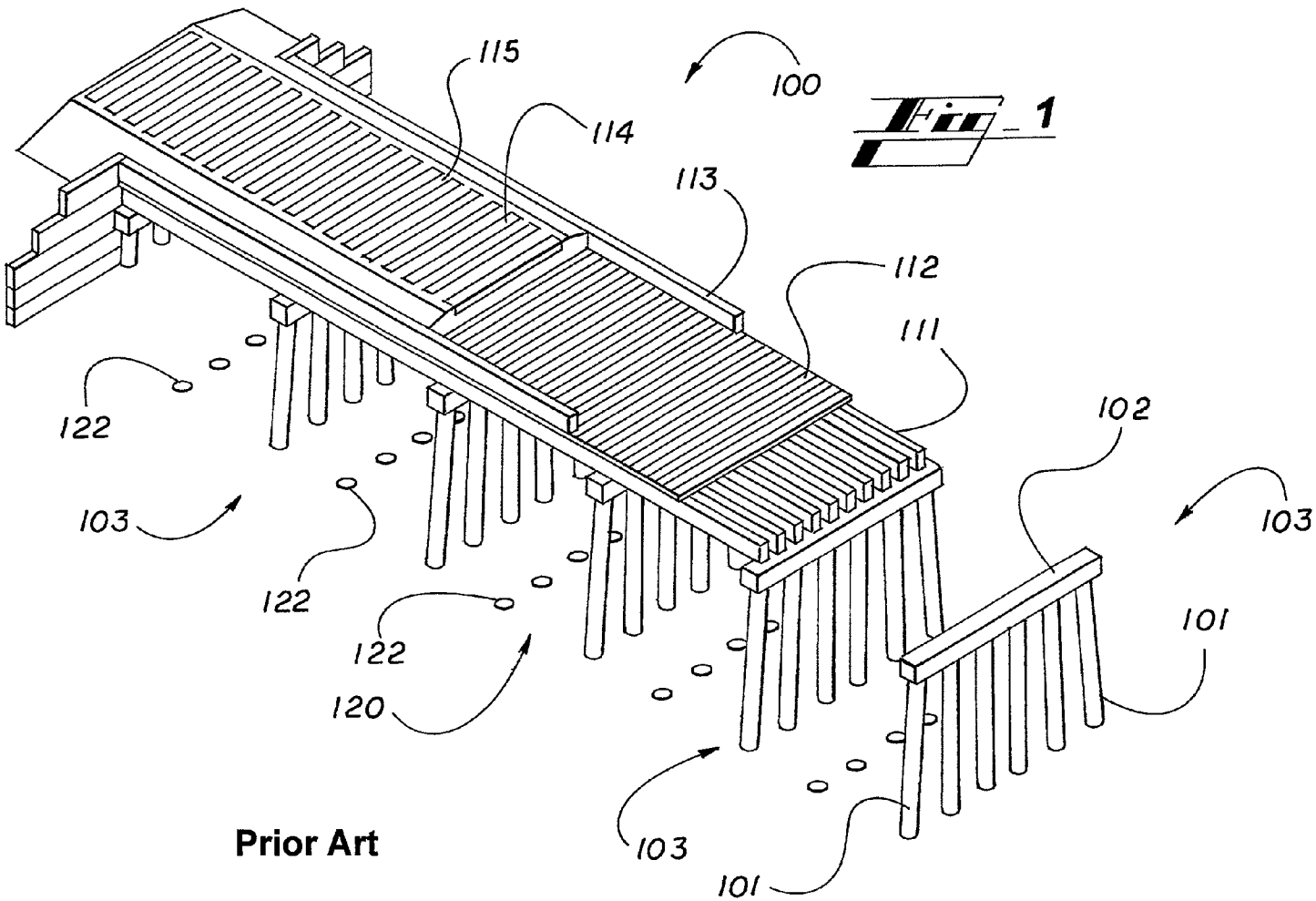
Fig. 1 Prior Art
FIG. 1 is a perspective view of a standard timber railroad bridge.

FIG. 1 illustrates the components of a standard timber railroad bridge 100. Such bridges 100 comprise a series of wooden bents 103 that span a waterway 120 or other geographic depression such as a gulley. Each bent 103 comprises several vertical timber piles 101 and a single timber cap 102. To construct bent 103, several vertical piles 101 are driven into the ground. As shown in FIG. 1, six vertical piles 101 are used to construct bent 103, although those skilled in the art recognize that additional or fewer piles 101 may be used. Cap 102 is then placed across the top of the piles 101 and fastened to the piles 101 using suitable means such as spikes or nails.

After all the bents 103 have been constructed over the waterway 120, timber stringers 111 are placed horizontally on top of bents 103 to provide a superstructure for the bridge. Thereafter, the bridge is completed by placing a timber road deck 112, timber curbs 113, cross ties 114, ballast 115, and rails (not shown) over the stringers 111.

Figure 2:
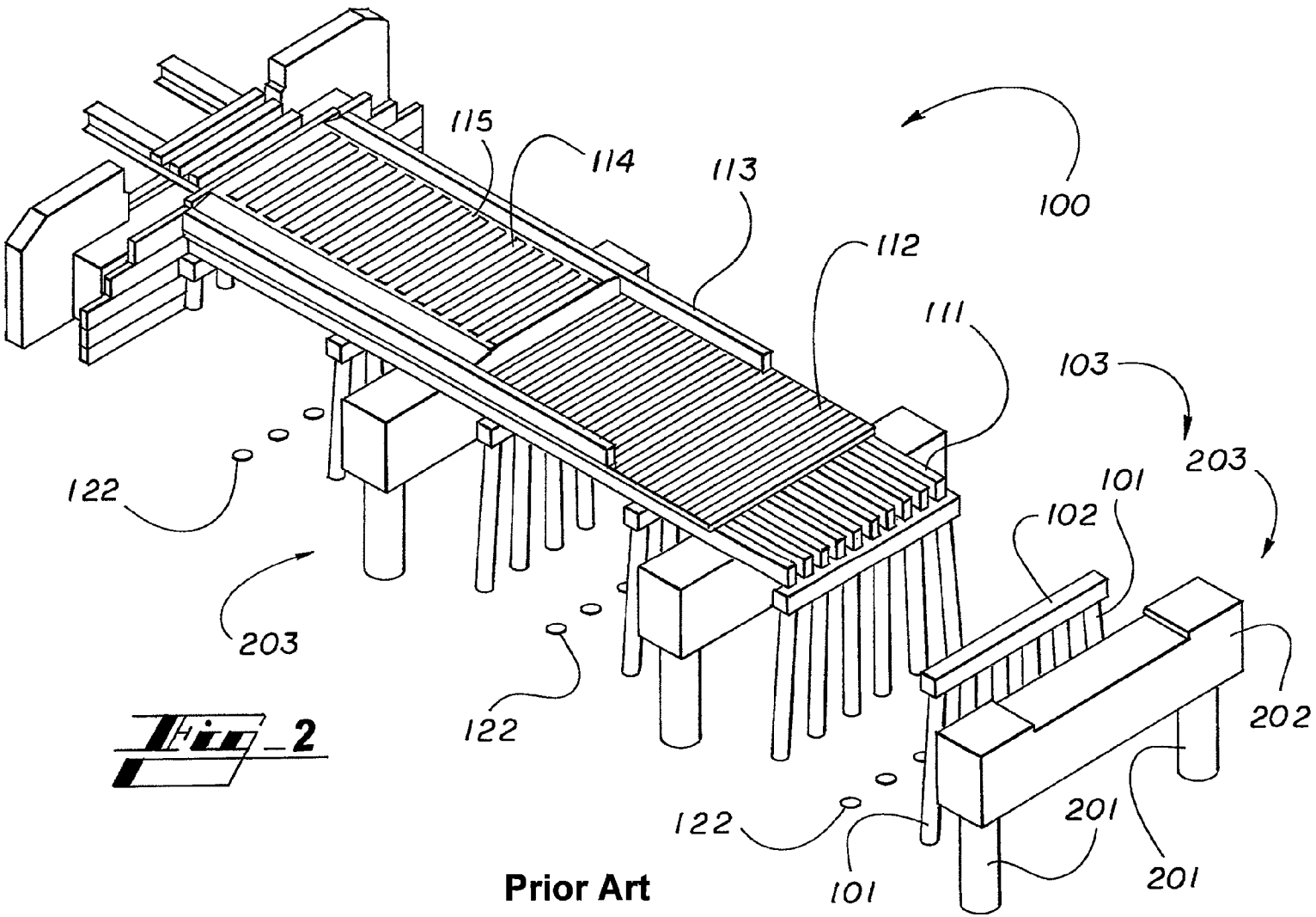
FIG. 2 shows a prior art method for constructing a replacement railroad bridge using cast-in-place construction techniques.

FIG. 2 shows a prior art method for constructing a replacement bridge using cast-in-place techniques. To begin the construction project, a pair of steel piles 201 is driven into the ground at intervals along the length of the existing bridge 100. Each steel pile 201 comprises an essentially cylindrical steel tube. Because the ground immediately beneath the existing bridge 100 is typically congested with the cutoff stubs 122 of old timber piles, the replacement steel piles 201 are driven into the ground some distance away from the pile stubs 122. The steel piles 201 are driven a sufficient distance into the ground until the tops of the steel piles 201 are at a height that concrete caps 202 can be constructed atop the piles 201 without interfering with the existing bridge 100. After being driven into the ground, each steel pile 201 is preferably reinforced with steel reinforcement bars ("rebar"). Concrete is then poured into each steel pile 201 and allowed to set.

Next, engineers use cast-in-place construction techniques to cast a cap 202 atop each pair of piles 201, thus creating a bent 203. First, the engineers place a cap form atop the pair of piles 201. Next, reinforcing bars are placed inside the cap form. Finally, concrete is poured into the cap form and allowed to set.

Because the existing bridge 100 is still in place and still supporting traffic, extreme care must be taken not to damage the existing bridge 100 when constructing the cap 202 atop the piles 201. Typically, there is only a 3-6 inch clearance between the cap 202 and the underside of the existing bridge 100 as the cap 202 is constructed atop the piles 201. Because of this low clearance and the need to protect the existing bridge 100, it is quite time consuming to construct each bent 203. The entire process of creating a cap form, reinforcing it with rebar, pouring concrete, allowing the concrete to cure, and performing load testing on the resulting cap 202 can take over a month.

After all of the replacement caps 202 have been constructed atop the piles 201 to form a series of replacement bents 203, the existing bridge 100 is demolished. Subsequently, concrete spans (not shown) are placed across the replacement bents 203 to create a replacement bridge superstructure. Thereafter, the roadbed, including cross ties, ballast, and rails are added to the bridge and the approaches to the bridge are reconfigured to align properly with the elevation of the replacement bridge.

Turning to FIGS. 3-17, an apparatus and method is shown that allows for a more rapid bridge replacement than has heretofore been possible. The resulting replacement bridge is also more robust and easier to maintain than the replacement bridge created using the construction method shown in FIG. 2.

Figure 3:
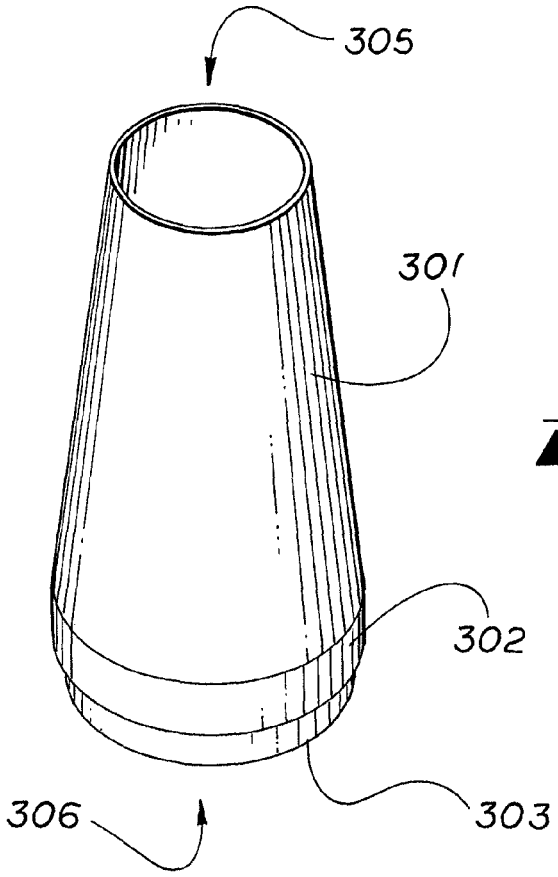
FIG. 3 is a perspective view of a male connector.
Figure 4:
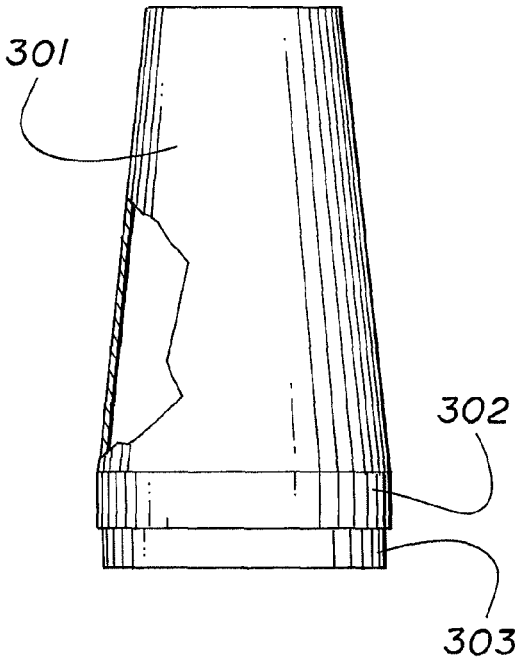
FIG. 4 is a partial cutaway side view of a male connector.
Figure 8:
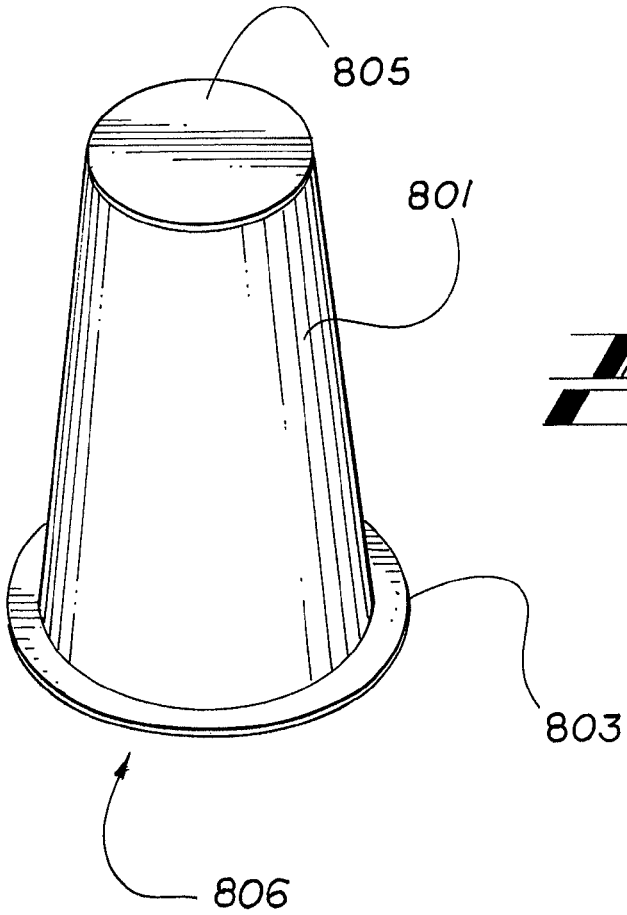
FIG. 8 is a perspective view of one embodiment of a female connector.
Figure 9:
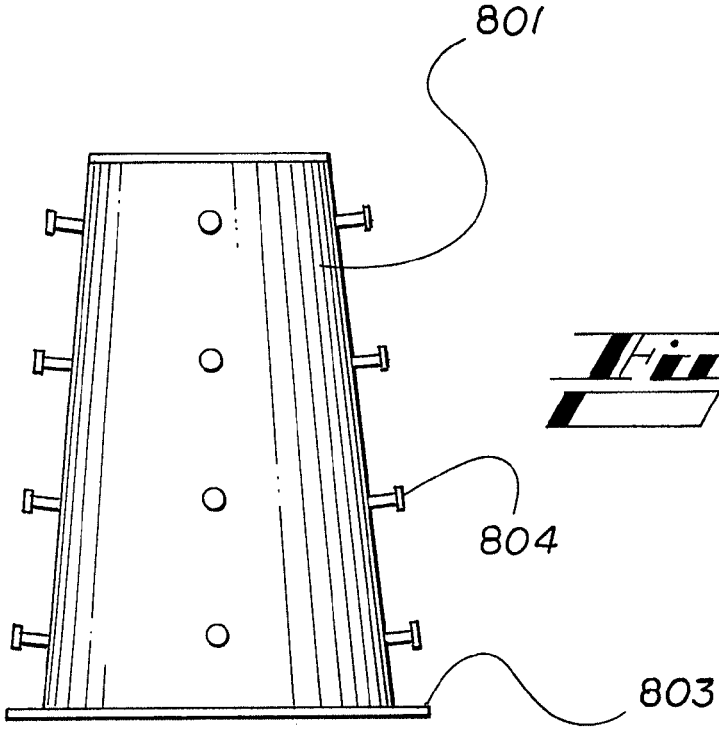
FIG. 9 is a side view of a second embodiment of a female connector.

FIGS. 3 and 4 show side views of a metallic male connector 301 used in conjunction with the improved construction method described herein. The male connector 301 comprises a substantially conical hollow metal form. The male connector 301 has a steel ring 302 in its base. The base also has a narrower steel guide flange 303 below ring 302. Openings on the top 305 and bottom 306 of male connector 301 advantageously allow concrete to be poured into male connector 301 after it has been attached to steel pile 501, as described below.

FIGS. 5-7 show how a male connector 301 is attached to the top of a steel pile 501. Guide flange 303 (FIGS. 3, 4) advantageously has a circumference just slightly less than the upper rim 503 (FIG. 6) of steel pile 501. Steel ring 302 (FIGS. 3, 4) preferably has the same circumference as the upper rim 503 (FIG. 6) of steel pile 501. Accordingly, the male connector 301 can be placed atop steel pile 501 (FIG. 5) with guide flange 303 fitting snugly inside the upper rim 503 of steel pile 501.

Figure 12:
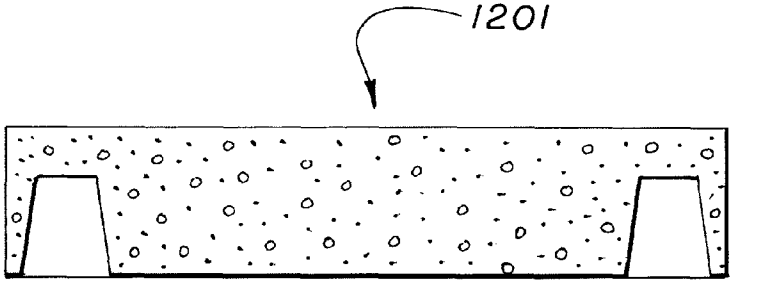
FIG. 12 is a cross-sectional side view of a cap with two female connectors of FIG. 8 embedded within the cap.

Male connector 301 also comprises a plurality of level adjustment devices 305 (FIGS. 5, 7) that are attached to the outside of steel ring 302. Similar level adjustment devices 505 are attached to the outside of steel pile 501 (FIGS. 5-7) near the top of the pile 501. A screw 701 (FIG. 7) is used to threadably engage the respective upper and lower level adjustment devices 305, 505. As described in more detail below, these level adjustment devices 305, 505 can be used at the worksite to ensure that the male connector 301 is properly aligned to engage a female connector 801 (FIG. 8) of a replacement cap 1201 (FIG. 12). After the male connector 301 has been aligned properly at the worksite, it can be welded onto the pile 501. Guide flange 303 advantageously provides a backing material ("backer") for the weld, thus ensuring a robust connection between the pile 501 and the male connector 301.

Turning now to FIGS. 8-12, the metallic female connector 801 is shown. The female connector 801 comprises a substantially conical form that is designed to fit over the male connector 301. The female connector 801 is preferably constructed of steel. The female connector 801 (FIGS. 8, 9) further comprises a solid top 805 and an opening on the bottom 806 to allow male connector 301 to fit inside female connector 801. The bottom of female connector 801 preferably has a lip 803 around its base and shear studs 804 (FIG. 9) attached to the exterior of female connector 801. The lip 803 and shear studs 804 advantageously engage the surrounding concrete after the female connector 801 has been cast into a cap 1201 (FIG. 12), thus allowing for the transfer of loads from the cap 1201 to the female connector 801.

Figure 11:
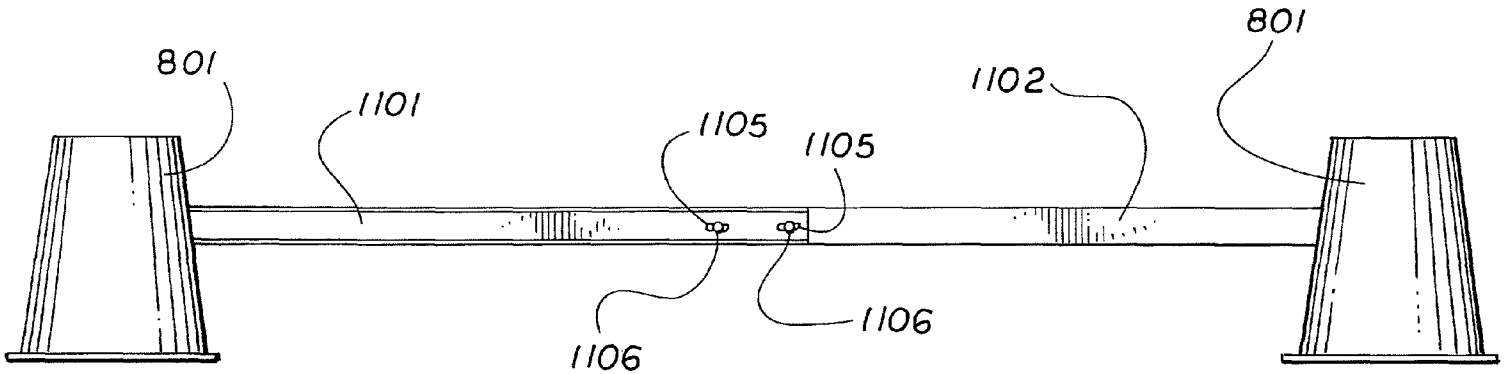
FIG. 11 is a side view of two channel guide members holding two female connectors of FIG. 8 at a particular distance from one another.
Figure 10:
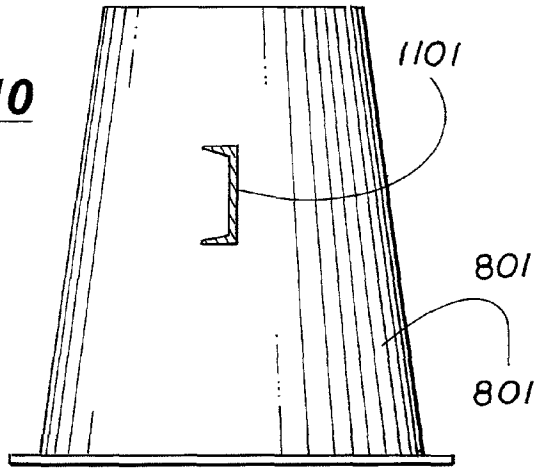
FIG. 10 is a side view of the female connector of FIG. 8 with an attached channel guide member.

FIGS. 10-12 illustrate how a pair of female connectors 801 can be cast into a concrete cap 1201 (FIG. 12). Before casting the concrete cap 1201, a pair of channel guide members 1101, 1102 (FIG. 11) are used to ensure that the female connectors 801 are spaced at the proper distance from one another. Each channel guide member 1101, 1102 preferably comprises a steel rod that can be attached to a female connector 801. Preferably, one end of channel guide member 1101 is cut at an angle that matches the slope of the sides of female connector 801. Channel guide member 1101 can preferably be attached to the side of female connector 801 by tack welding or other suitable means. The other end of the channel guide member 1101 contains one or more slotted holes 1105 (FIG. 11). A second channel guide member 1102 likewise contains slotted holes 1105 at one end that can match up with the slotted holes on the first channel guide member 1101. The second end of channel guide member 1102 can be attached to the side of a second female connector 801 by tack welding or other suitable means. The distance between the pair of female connectors 801 can be adjusted by sliding the channel guide members 1101, 1102 in a lateral direction. After the distance has been properly adjusted, bolts 1106 are inserted into the slotted holes 1105 and threaded nuts are screwed onto the end of the bolts 1106 to fasten the channel guide members 1101, 1102 to one another, thus locking the female connectors 801 in place to retain their relative positions during casting of the cap 1201, as described below.

Next, the pair of female connectors 801 and the connecting channel guide members 1101, 1102 are cast into a concrete cap 1201 (FIG. 12) using concrete forms or other casting techniques. The concrete cap 1201 is preferably reinforced with steel rebar. As shown in FIG. 12, the completed cap 1201 will have the pair of female connectors 801 embedded in the underside of the cap 1201. As described in detail below, this will allow the male connectors 301 on top of the piles 501 to fit inside the female connectors 801 embedded in the cap 1201.

Turning now to FIGS. 13-17, a method of constructing a replacement bridge is shown. First, as described above, hollow tubular steel piles 501 (FIG. 5) and male connectors 301 (FIGS. 3, 4) are prefabricated in a controlled factory environment. As described in more detail below, the male connectors 301 are sized so the female connectors 801 (FIGS. 8, 9) will mate with and seat on the male connectors 301. Accordingly, female connectors 801 can be prefabricated at the same time that the male connectors 301 are being prefabricated. The steel piles 501 and male connectors 301 are then brought to the worksite where an existing bridge 100 (FIG. 13) is to be replaced.

To begin the construction process, pairs of steel piles 501 are driven into the ground at intervals along the length of existing bridge 100. As noted above, the distance between each pair of piles 501 is usually wider than the width of the existing bridge 100 (FIG. 13) because of the congested area immediately underneath the bridge which often contains the cutoff stubs 122 of old timber piles. Engineers then preferably insert reinforcing bars into the driven piles.

Figure 13:
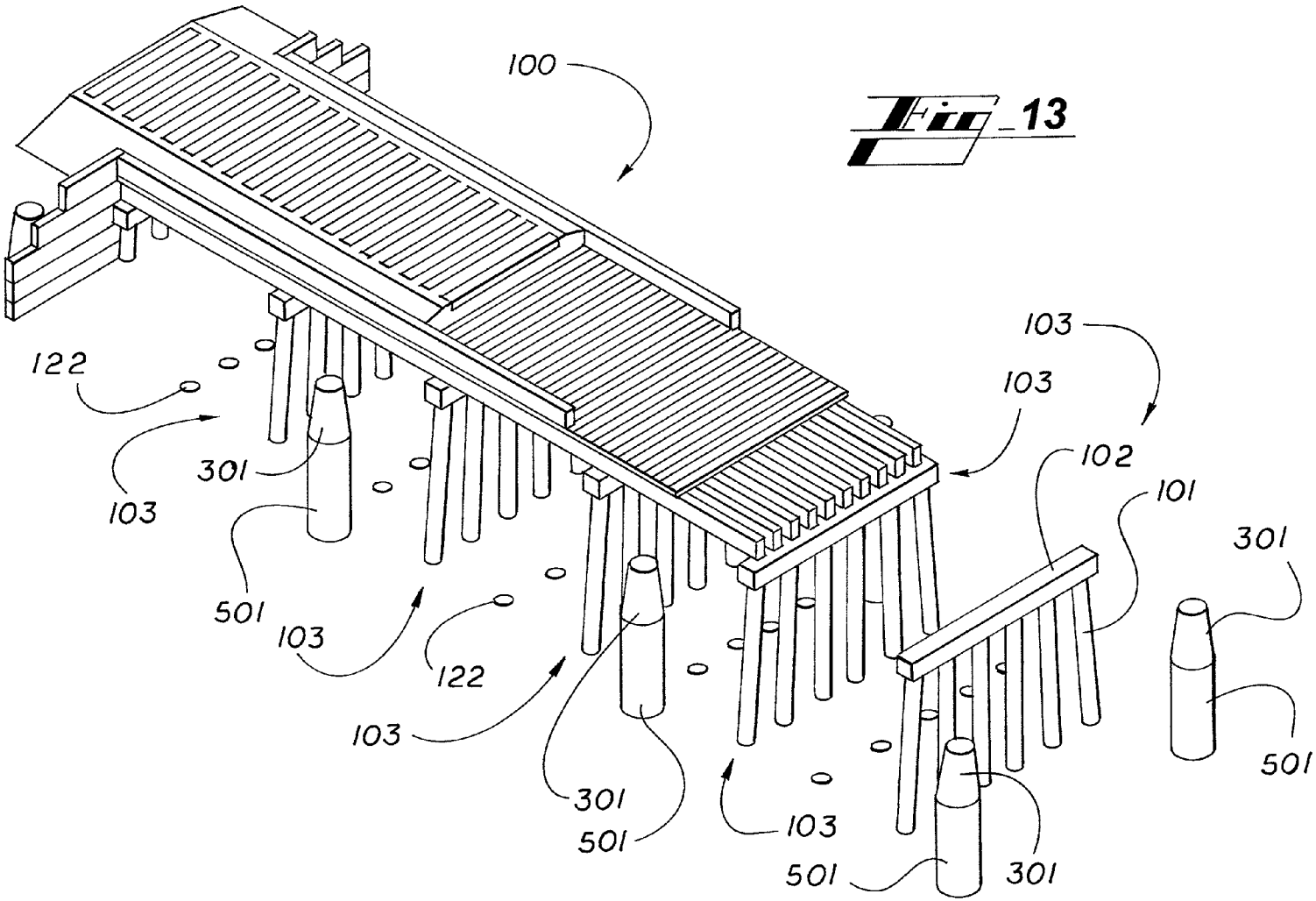
FIG. 13 illustrates the first steps in constructing a replacement bridge using the apparatus and the pre-cast techniques disclosed herein.
Figure 14:
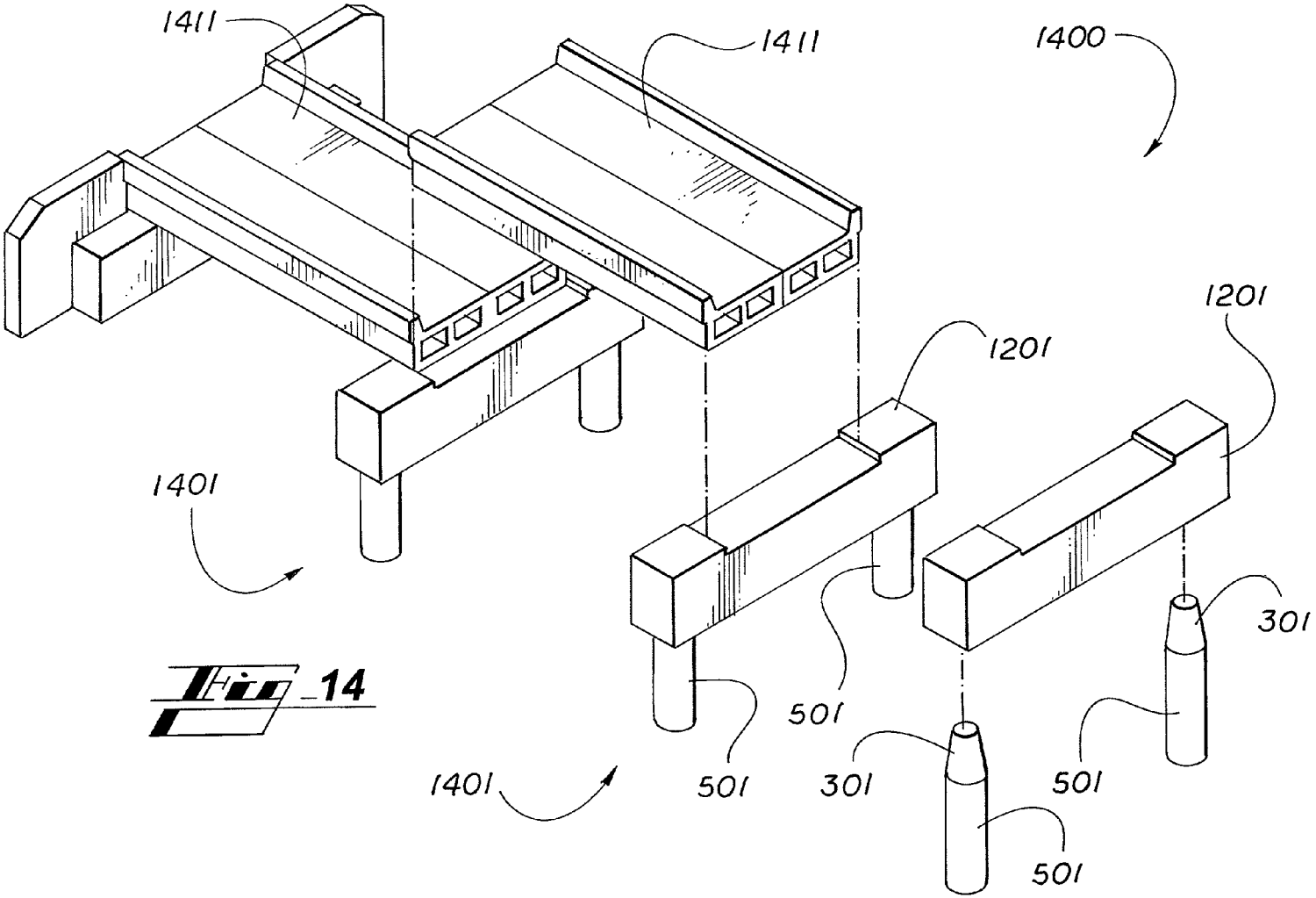
FIG. 14 illustrates the final steps in constructing a replacement bridge using the apparatus and the pre-cast techniques disclosed herein.

Next, the prefabricated male connectors 301 are placed atop the driven steel piles 501. As discussed earlier, guide flange 303 (FIGS. 3, 4) is used to guide the lower end of male connector 301 into the top of steel pile 501. Because the diameter of steel ring 302 (FIG. 4) is equal to or greater than the diameter of upper rim 503 (FIG. 7) of steel pile 501, the male connector 301 will rest on top of pile 501, as shown in FIGS. 5 and 13. Preferably, the diameter of steel ring 302 is substantially equal to the diameter of upper rim 503.

After a male connector 301 has been placed atop a steel pile 501, engineers can use the level adjustment devices 305, 505 (FIGS. 5-7) to finely tune the positioning of the male connector 301 and ensure that it will be level and will properly align with one of the female connectors 801 (FIG. 12) embedded in a cap 1201. Screws 701 (FIG. 7) are used in conjunction with the level adjustment devices 305, 505 to threadably engage the level adjustment devices 305, 505 to slightly raise or lower the side of male connector 301 where the particular level adjustment device 305, 505 is located. Male connector 301 is next welded to the top of steel pile 501. As described earlier, guide flange 303 advantageously provides a backing material for the weld, thus ensuring a robust connection between the pile 501 and the male connector 301.

Next, engineers will reinforce the steel pile 501 and its attached male connector 301 by pouring concrete into the opening 305 (FIG. 3) of male connector 301 (FIG. 13) as it sits on top of a steel pile 501.

After the male connectors 301 and the steel piles 501 have been filled with concrete, engineers will measure the exact distance between each pair of piles 501. These measurements are then provided to the manufacturer of the prefabricated caps 1201 so customized caps can be constructed off-site to exactly fit over the pairs of steel piles 501 that have been driven into the ground and the male connectors 301 that have been welded to the tops of the piles 501.

The manufacturer of the prefabricated caps 1201 will utilize the aforementioned distance measurements to cast the caps 1201 with a pair of female connectors 801 embedded within each cap 1201 (FIG. 12). Preferably, the manufacturer will have prefabricated multiple female connectors 801 in advance so the manufacturer can utilize the female connectors 801 to cast the caps 1201. As described earlier, the female connectors 801 must be constructed so they will mate with and seat on the male connectors 301 that have already been installed atop the piles 501 (FIG. 11) at the worksite. The manufacturer will also preferably have prefabricated multiple channel guide members 1101, 1102 (FIG. 11) in advance for use in casting the caps 1201.

To cast a cap 1201, the manufacturer will begin by attaching a first channel guide member 1101 (FIG. 11) to a first female connector 801. The manufacturer will then attach a second channel guide member 1102 to a second female connector. The channel guide members 1101, 1102 can be attached to their respective female connectors 801 by tack welding or other suitable means. Next, the two channel guide members 1101, 1102 will be positioned so they can slidably engage one another as shown in FIG. 11. The distance between the pair of female connectors 801 will be adjusted by sliding the channel guide members 1101, 1102 until the distance between the pair of female connectors 801 matches the measured distance between a pair of driven piles 501 (FIG. 13) at the worksite. After the distance between the connectors 801 has been adjusted, the female connectors 801 are locked in place by inserting bolts 1106 into slotted holes 1105 and securing the bolts 1106 in place with threaded nuts screwed onto bolts 1106.

The manufacturer will then fabricate the cap 1201, embedding the properly spaced female connectors 801 within the cap 1201. Preferably, the manufacturer will fabricate the cap 1201 by creating a cap form having a desired shape for the cap 1201. Next, the manufacturer will place the properly spaced female connectors 801 inside the form along with reinforcing bars. Finally, the manufacturer will pour concrete into the form and allow the concrete to cure. As shown in FIG. 12, the cap 1201 will be constructed so the hollow bottom openings 806 (FIG. 8) of the female connectors 801 are exposed to the underside of the cap 1201. As stated previously, each embedded female connector 801 preferably has a lip 803 (FIG. 8, 9) around its base and shear studs 804 (FIG. 9) attached to the female connector's 801 exterior to engage the surrounding concrete in the cap 1201 (FIG. 12), thus allowing for the transfer of loads from the cap 1201 to the female connectors 801 when the cap 1201 is positioned atop the piles 501 and male connectors 301 (FIG. 14), as described below. Each customized cap 1201 is preferably marked after it is fabricated so the cap 1201 may be attached to the proper pair of piles 501 at the worksite. That is, the customized cap 1201 is marked so it may be matched with the pair of piles 501 having a separation distance that equals the distance between the female connectors 801 embedded within the customized cap 1201.

Advantageously, traffic can continue to flow over the existing bridge 100 (FIG. 13) during the time-consuming process of driving piles 501 into the ground, inserting reinforcing bars into the piles 501, fitting the piles 501 with male connectors 301, welding the male connectors 301 to the piles 501, reinforcing the piles 501 and male connectors 301 with concrete, prefabricating the caps 1201 off-site, and allowing the concrete in the piles 501, male connectors 301, and prefabricated caps 1201 to set, all of which may take two to four weeks, or longer. After these steps have been completed and the prefabricated caps 1201 have been delivered to the worksite, traffic will be stopped over the existing bridge 100 and the existing bridge 100 will be dismantled by cutting the existing timber piles 101 at the groundline and removing the timber bents 103 and the remainder of the bridge 100.

Figure 15:
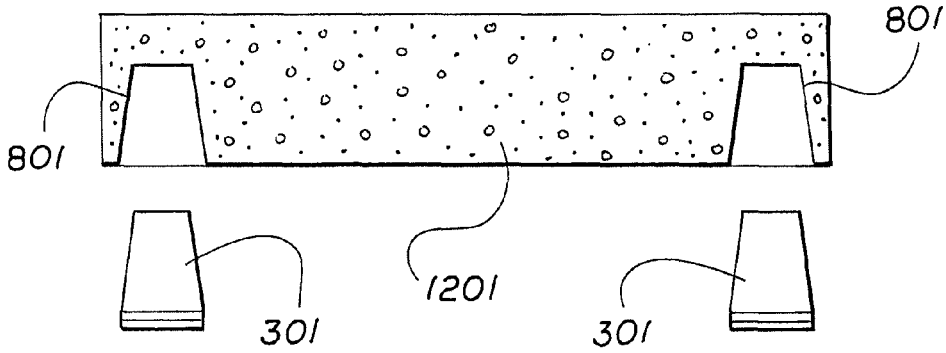
FIGS. 15-17 illustrate how a pre-cast cap containing female connectors is lowered onto a pair of male connectors.
Figure 16:
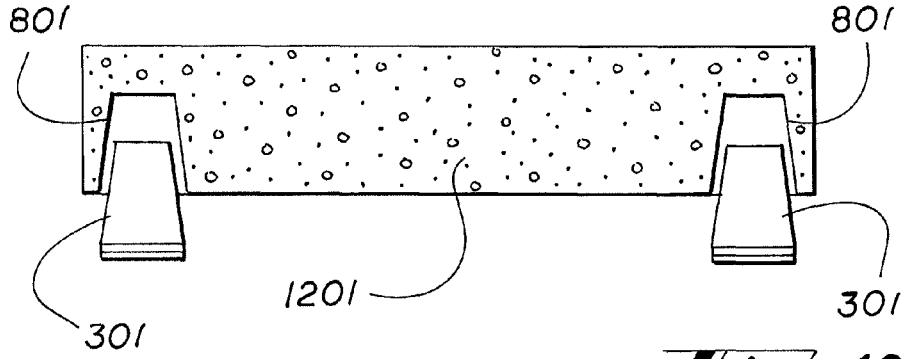
Figure 17:
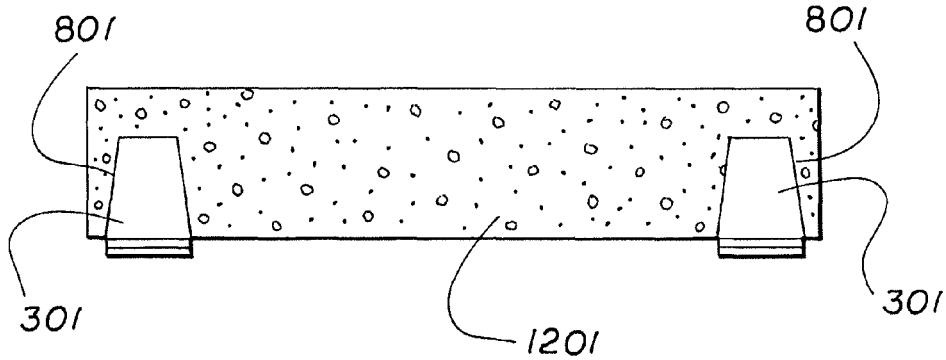

Next, as shown in FIGS. 14-17, the prefabricated caps 1201 can be lowered atop the successive pairs of piles 501 to form replacement bents 1401. Advantageously, the female connectors 801 embedded within the caps 1201 will mate with and seat on the male connectors 301 that sit atop the steel piles 501. As described below, the female connectors 801 and male connectors 301 preferably have a tapered shape such that the cap 1201 will properly align with the male connectors 301 sitting atop the steel piles 501 as the cap 1201 is lowered onto the male connectors 301 of the piles 501 as shown in FIGS. 15-17. Once lowered onto the piles 501, the caps 1201 are held in place by the tight coupling of the tapered female connectors 801 with the tapered male connectors 301. This tight coupling advantageously provides for a very secure connection between the caps 1201 and piles 501 that requires little maintenance.

Next, concrete spans 1411 are placed on top of successive bents 1401, thus completing the superstructure of the replacement bridge 1400. Advantageously, the piles 501, caps 1201, and spans 1411 are positioned at a height such that the replacement bridge 1400 will be at the same height as the pre-existing bridge. Finally, the remainder of the track bed is constructed and the replacement bridge 1400 can be opened to traffic.

As discussed above with respect to FIG. 2, the prior art methods for casting caps in place at the worksite and allowing the caps to cure are laborious and time consuming. Rail line operators have been unwilling to shut down their rail lines for the extended period of time required to construct the caps atop the piles using such cast-in-place techniques. Consequently, the replacement caps have been positioned at a lower elevation than the pre-existing bridge in order to allow the continued flow of traffic over the bridge during the long casting process. This lower elevation, however, has the further adverse consequence of making the bridge more prone to flooding. In addition, builders using such cast-in-place construction techniques are further slowed because they must be careful not to damage the existing bridge during the casting process.

The quick construction process disclosed herein, however, obviates all of these problems. Because the prefabricated caps 1201 (FIG. 14) have already cured and can be placed so rapidly in place atop the piles 501, it is acceptable to stop the traffic on the pre-existing bridge and demolish the bridge before constructing the replacement bridge 1400. The demolishing of the pre-existing bridge, in turn, permits the replacement bridge 1400 to be erected at the same height as the pre-existing bridge, thus eliminating any differential in elevation between the replacement bridge 1400 and the approaches to the bridge.

In alternate embodiments, different matching shapes can be used for the male and female connectors 301, 801 than the conical frusta shown in FIGS. 3-17. Such alternate shapes include, but are not limited to, circular or elliptical cones; pyramids; pyramidal, elliptical, or spherical frusta or other frusta; circular or elliptical cylinders; hemispheres or other partial spheres or partial ellipsoids; cubes or other rectangular solids; wedges; prismatoids; cupolas; and polyhedra. Irregular three dimensional shapes may also be used, including shapes with curved surfaces and/or irregular projections or indentations along their surfaces. Preferably, the sides of any such regular or irregular shape will generally taper or curve inwards towards the top of such shape, thus allowing the female connector 801 to easily mate with and seat on the male connector 301 as shown in FIGS. 15-17. Examples of such preferred alternate shapes with tapered sides include pyramids, pyramidal frusta, and wedges. Alternatively, the sides of any such regular or irregular shape may be vertical such as a cube or other rectangular solid, although such a shape will require more precise positioning as the caps are positioned onto the piles. Preferably, such alternate shapes will distribute weight evenly to the piles without creating unnecessary stress points.

The shapes of the piles 501 can also be varied in alternative embodiments. Piles may be used having a rectangular, triangular, elliptical, or other shaped cross-section, including irregular shapes. Alternatively, piles may be used that are not enclosed, including, but not limited to I-beams. The upper surface of any such alternately shaped pile 501 must be such that it can mate properly with the lower surface of the male connector 301, thus allowing the male connector 301 to be positioned atop the pile 501. For instance, a pile with a rectangular cross-section should preferably be mated with a male connector that has a rectangular base of an equal size, such as a pyramidal frustum with a rectangular base.

Accordingly, while the invention has been described with reference to the structures and processes disclosed, it is not confined to the details set forth, but is intended to cover such modifications or changes as may fall within the scope of the following claims.

What is claimed is:

1. A connected pile and cap member comprising:

a) a pile having a top;

b) a male connector including a male base, a male top, and a male side connecting the male base to the male top, i) wherein the male connector is tapered such that the top of the male connector has a narrower cross-sectional area than the cross-sectional area of the base of the male connector;

ii) wherein the male connector is a separate element from the pile, and iii) wherein the male base is attached to the top of the pile;

c) a cap; and d) a female connector including a female base, a female top, and a female side connecting the female base to the female top, i) wherein the female connector is tapered such that the top of the female connector has a narrower cross-sectional area than the cross-sectional area of the base of the female connector;

ii) wherein the female connector is a separate element from the cap, and iii) wherein the female connector is embedded in the cap;

wherein the male connector and of the female connector are substantially similar in shape so that the male connector fits inside the female connector and engages the female connector in order to support the cap on the pile.

2. The connected pile and cap member of claim 1 wherein the top of the female connector is closed and the bottom of the female connector is open.

3. The connected pile and cap member of claim 2 wherein the male connector has an opening on top and an open bottom and is substantially hollow.

4. The connected pile and cap member of claim 1 wherein the shape of the male connector is selected from the group consisting of cone, conical frustum, pyramid, pyramidal frustum, partial ellipsoid, elliptical frustum, hemisphere, partial sphere, spherical frustum, and wedge, and wherein the shape of the female connector is selected from the group consisting of cone, conical frustum, pyramid, pyramidal frustum, partial ellipsoid, elliptical frustum, hemisphere, partial sphere, spherical frustum, and wedge.

5. The connected pile and cap member of claim 1 wherein the connected pile and cap member comprises a pair of spaced apart piles each with one of the male connectors attached thereto and a pair of female connectors embedded in the cap and connected by a channel guide member attached to the side of each female connector, wherein the guide members are adjustably connected to establish a space between the embedded female connectors, which space matches the space between the male connectors attached to the piles.

6. The connected pile and cap member of claim 1 wherein the bottom of the male connector further comprises a flange, said flange being adapted to fit snugly inside the top of the pile member and aid in positioning the male connector atop the pile member.

7. The connected pile and cap member of claim 6 wherein the male connector further comprises at least one level adjustment device, and wherein the pile member comprises at least one level adjustment device for aligning the male connector with the female connector.

8. A method for constructing a replacement bridge in place of a pre-existing bridge having a length and a width with opposite sides, the method comprising the steps of:

a) prefabricating a plurality of separate male connectors in a controlled environment, each male connector including a male base, a male top, and a male side connecting the male base to the male top, wherein the male connectors are separately fabricated from a plurality of pile members;

b) prefabricating a plurality of separate female connectors in a controlled environment, each female connector including a female base, a female top, and a female side connecting the female base to the female top, wherein (i) the female connector is substantially hollow, (ii) the male connector is substantially similar in shape to the female connector, and (iii) the female connector is capable of mating with and seating on the male connector with the sides of the female connector in substantial communication with the sides of the male connector, thereby allowing weight born by the female connector to be transferred to the male connector;

c) transporting the prefabricated male connectors to a worksite adjacent the pre-existing bridge;

d) installing at least one pile member in the ground on opposite sides of the pre-existing bridge without removing the pre-existing bridge, thereby creating a set of driven pile members adjacent the pre-existing bridge;

e) positioning one of the plurality of male connectors fabricated in step (a) atop each pile member installed in the ground in step (d);

f) connecting each installed pile member to the male connector placed atop said pile member in step (e);

g) measuring the distance between the pile members installed in the ground in step (d) on opposite sides of the pre-existing bridge and recording said distance measurement as well as the location of the corresponding pile members on opposite sides of the pre-existing bridge;

h) repeating steps (d)-(g) at intervals along the length of the pre-existing bridge where a new bent is desired;

i) prefabricating a cap member in a controlled factory environment using two or more of the female connectors fabricated in step (b), wherein the female connectors are embedded in the cap member such that the embedded female connectors in said cap member are spaced to match the distances between one set of installed pile members that were recorded in step (g);

j) repeating step (i) for each set of installed pile members to produce a plurality of cap members;

k) transporting the cap members with embedded and spaced female connectors fabricated in step (i) to the worksite;

l) demolishing the pre-existing bridge in its entirety;

m) creating a bent by positioning a cap member with embedded and spaced female connectors fabricated in step (i) on top of a set of installed pile members, wherein the distance between the female connectors embedded within said cap member matches the distance between the pile members in said set of installed pile members, and wherein each female connector embedded within said cap member is aligned with and mates with one of the male connectors that has been connected to the top of one of the pile members in said set of installed pile members;

n) repeating step (m) for each set of installed pile members, thereby creating a series of bents; and o) positioning a plurality of spans across the series of bents, thereby creating a superstructure for the replacement bridge.

9. The method of claim 8 wherein the shapes of the male connectors fabricated in step (a) are substantially tapered such that the top of each male connector has a narrower cross-sectional area than the cross-sectional area of the base of the male connector, and wherein the shapes of the female connectors fabricated in step (b) are substantially tapered such that the top of each female connector has a narrower cross-sectional area than the cross-sectional area of the base of the female connector.

10. The method of claim 8 wherein the shape of each male connector is selected from the group consisting of cone, conical frustum, pyramid, pyramidal frustum, partial ellipsoid, elliptical frustum, hemisphere, partial sphere, spherical frustum, and wedge, and wherein the shape of each female connectors is selected from the group consisting of cone, conical frustum, pyramid, pyramidal frustum, partial ellipsoid, elliptical frustum, hemisphere, partial sphere, spherical frustum, and wedge.

11. The method of claim 8 wherein step (i) further comprises attaching a channel guide member to the side of each female connector and fastening the channel guide members together to maintain the relative spacing of the embedded female connectors, wherein the guide members are adjustably connected to establish a space between the embedded female connectors, which space matches the space between the male connectors attached to the piles.

12. The method of claim 9, wherein each male connector fabricated in step (b) further comprises a flange, said flange being adapted to fit snugly inside the top of a pile member and aid in positioning the male connector atop the pile member.

13. The method of claim 12, wherein each male connector fabricated in step (a) further comprises at least one level adjustment device, and wherein each pile member comprises at least one level adjustment device, and wherein step (e) further comprises utilizing said level adjustment devices to precisely control the orientation of said male connector atop said installed pile member.

14. A connected pile and cap member for supporting a structure comprising:

a) a pile and a male connector, i) wherein the pile has a top;

ii) wherein the male connector includes a male base, a male top, and a male side connecting the male base to the male top;

iii) wherein the male connector is tapered such that the top of the male connector has a narrower cross-sectional area than the cross-sectional area of the base of the male connector;

iv) wherein the male connector is a separate element from the pile, and v) wherein the male base is attached to a top of the pile; and b) a prefabricated cap and female connector, and i) wherein the female connector includes a female base, a female top, and a female side connecting the female base to the female top;

ii) wherein the female connector is tapered such that the top of the female connector has a narrower cross-sectional area than the cross-sectional area of the base of the female connector;

iii) wherein the female connector is a separate element from the cap, and iv) wherein cap is cast around the female connector to embed the female connector in the cap; and v) wherein the cap is allowed to cure, wherein the male connector and of the female connector are substantially similar in shape so that the male connector fits inside the female connector and engages the female connector in order to connect the cap to the pile after the cap and the female connector have been prefabricated and the cap has cured.

15. The connected pile and cap member of claim 14 wherein the top of the female connector is closed and the bottom of the female connector is open.

16. The connected pile and cap member of claim 15 wherein the male connector is substantially hollow.

17. The connected pile and cap member of claim 16 wherein the top of the male connector has an opening and the bottom of the male connector is open.

18. The connected pile and cap member of claim 14 wherein the shape of the male connector is selected from the group consisting of cone, conical frustum, pyramid, pyramidal frustum, partial ellipsoid, elliptical frustum, hemisphere, partial sphere, spherical frustum, and wedge, and wherein the shape of the female connector is selected from the group consisting of cone, conical frustum, pyramid, pyramidal frustum, partial ellipsoid, elliptical frustum, hemisphere, partial sphere, spherical frustum, and wedge.

19. The connected pile and cap member of claim 14 wherein the connected pile and cap member comprises a pair of spaced apart piles each with one of the male connectors attached thereto and a pair of female connectors embedded in the cap and connected by a channel guide member attached to the side of each female connector, wherein the guide members are adjustably connected to establish a space between the embedded female connectors, which space matches the space between the male connectors attached to the piles.

20. The connected pile and cap member of claim 14 wherein the bottom of the male connector further comprises a flange, said flange being adapted to fit snugly inside the top of the pile member and aid in positioning the male connector atop the pile member.

21. The connected pile and cap member of claim 20 wherein the male connector further comprises at least one level adjustment device, and wherein the pile member comprises at least one level adjustment device for aligning the male connector with the female connector.

* * * * *